US007044766B2

(12) United States Patent
Saka et al.

(10) Patent No.: US 7,044,766 B2
(45) Date of Patent: May 16, 2006

(54) AUTOMOTIVE ELECTRICAL CONNECTION BOX AND METHOD OF ASSEMBLING THEREOF

(75) Inventors: Yukinori Saka, Yokkaichi (JP); Tooru Nakagawa, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/910,898

(22) Filed: Aug. 4, 2004

(65) Prior Publication Data

US 2005/0176276 A1 Aug. 11, 2005

(30) Foreign Application Priority Data

Feb. 10, 2004 (JP) ..... 2004-034127

(51) Int. Cl.
*H01R 13/627* (2006.01)

(52) U.S. Cl. ..... 439/364

(58) Field of Classification Search ..... 439/76.2, 439/364, 362, 701
See application file for complete search history.

(56) References Cited

U.S. PATENT DOCUMENTS 5,266,047 A * 11/1993 Black et al. ..... 439/364
5,567,182 A * 10/1996 Ishii et al. ..... 439/701
5,711,630 A * 1/1998 Kodama ..... 403/329
5,771,151 A * 6/1998 Hotea et al. ..... 361/626
5,813,880 A * 9/1998 Kodama ..... 439/364
5,934,926 A * 8/1999 Gabrisko et al. ..... 439/364
5,993,228 A * 11/1999 Kubota ..... 439/164
6,053,758 A * 4/2000 Kato et al. ..... 439/364
6,231,369 B1 * 5/2001 Miyajima et al. ..... 439/364

* cited by examiner

*Primary Examiner*—Phuong Dinh
(74) *Attorney, Agent, or Firm*—Gerald E. Hespos; Anthony J. Casella

(57) ABSTRACT

An automotive electrical connection box (10) has a casing main body (11) fastened to a holder (20) by a bolt (B). A mating connector (12) is mounted in the casing main body (11) and is connected with a waiting-side connector (21) in the holder (20) simultaneously with the fastening by the bolt (B). A dummy housing (13) projects from the casing main body (11) at a side of the bolt (B) opposite the mating connector (12), and an opening (22) is provided at a portion of the holder (20) corresponding to the dummy housing (13). The dummy housing (13) and the opening (22) engage and create a stress to balance a stress created upon connecting the waiting-side connector (21) and the mating connector (12).

11 Claims, 10 Drawing Sheets

AUTOMOTIVE ELECTRICAL CONNECTION BOX AND METHOD OF ASSEMBLING THEREOF

BACKGROUND OF THE INVENTION

1. Field of the Invention

The invention relates to an automotive electrical connection box and to a method of assembling an automotive electrical connection box.

2. Description of the Related Art

Japanese Unexamined Patent Publication No. 2002-58128 and FIG. 9 herein disclose an electrical connection box. With reference to FIG. 9, the electrical connection box has a lower cover 1, a casing main body 2 and an upper cover 3 that are locked together by locks 1*a*, 2*a*, 3*a* on the surrounding walls. A bracket 2*b* projects from the casing main body 2 and is fastened to a vehicle body or the like by a bolt. The lower cover 1 is usually hollow and frequently is a place where wires W are drawn out the casing main body 2.

FIG. 10 shows another known an electrical connection box that has a holder 5 and a casing main body 6. The holder 5 is to be fixed to a fixing member such as a vehicle body. Substantially center positions of the holder 5 and the casing main body 6 are fastened and fixed by a bolt B. A waiting-side connector 7 is mounted in the holder 5 and a mating connector 8 is provided in the casing main body 6. The waiting-side connector 7 is connected to the mating connector 8 by tightening the bolt, as shown in FIG. 10.

The bolt B is introduced through a bolt introducing portion of the casing main body 6 and engages a nut N embedded in the holder 5. Stresses act equally on the waiting-side connectors 7 and the mating connectors 8 if the waiting-side connectors 7 are mounted symmetrically at opposite sides of the bolt B. In this situation, the mating connectors 8 are not inserted obliquely and the connectors 7, 8 are connected properly with each other.

In some situations, the waiting-side connector 7 is only at one side of the bolt B. Thus, the bolt B is subjected to a stress at a connector connecting side, but is subjected to no stress at the side that has no connector connecting portion. As a result, the casing main body 6 is inserted obliquely so that the connector connecting side is higher and the non-connecting side is lower, as shown in FIG. 10. Therefore, the connectors 7, 8 are likely to be damaged and terminals in the connectors 7, 8 are likely to be deformed.

The present invention was developed in view of the above problem and an object thereof is to enable the proper connection of connectors.

SUMMARY OF THE INVENTION

The invention relates to an electrical connection box with a casing main body and a holder that can be connected together by a fastener. A mating connector is mounted in the casing main body and a waiting-side connector is mounted in the holder. The mating connector and the waiting-side connector are connected as the casing main body is connected to the holder. More particularly, the mating connector and the waiting side connector are connected without making the casing main body oblique to the holder even though a connector connecting portion is not symmetrical with respect to the fastener.

The electrical connection box preferably has a stress creating portion at a side of the casing main body and/or holder substantially opposite to the mating connector and/or the waiting-side connector with respect to the fastener. The stress creating portion creates a stress that substantially balances a stress created by connecting the waiting-side connector and the mating connector. Thus, the casing main body can be connected with the holder substantially straight along the connecting direction without being held oblique thereto. Accordingly, the waiting-side connector can be connected properly with the mating connector without damaging the terminals.

The fastener preferably comprises a bolt.

The stress creating portion may comprise a dummy housing that projects substantially along the connecting direction from the casing main body. The stress creating portion may also comprise an opening at a portion of the holder substantially corresponding to the dummy housing. A force for fitting the dummy housing into the opening substantially balances the stress created upon connecting the waiting-side connector and the mating connector.

At least one reinforcing rib may be inside of the dummy housing and may define a lattice shape. The reinforcing rib prevents the dummy housing from deforming inward in a manner that would avoid creating the necessary stress when the dummy housing is fit into the opening. The dummy housing may have cavities similar to the mating connector to be connected with the waiting-side connector. Thus, a stress is created similar to the stress created at the connector connecting portion of the waiting-side connector.

The inner periphery of the opening that receives the dummy housing may be dimensioned so that the outer periphery of the dummy housing is closely fittable therein. The force for closely fitting the dummy housing into the opening may be balanced substantially with the stress created upon connecting the waiting-side connector and the mating connector.

The opening that receives the dummy housing may have a step for contacting the front end of the dummy housing. Thus, the tightening of the bolt can be stopped at a specified position when the end surface of the dummy housing contacts the step.

The dummy housing preferably can be pressed into the opening while giving a proper sense of an ongoing fitting process to an operator. For example, at least one lock may project from the outer periphery of the dummy housing, and at least one mating lock may project from the inner periphery of the opening into which the dummy housing is fittable. The lock may engage with a front surface, a recess and a rear surface of the mating lock in a stepwise manner when the dummy housing is fit into the opening.

The dummy housing may project integrally or unitarily from the casing main body. However, the electrical connection box also can be constructed for use when the connector connecting portions of the waiting-side connector and the mating connector are at opposite sides of the bolt. For example, the dummy housing portion may be mounted detachably in an opening in the casing main body. The opening may be shaped so that the waiting-side connector also is detachably mountable therein.

The invention also relates to a method of assembling an automotive electrical connection box. The method preferably comprises connecting a mating connector in a casing main body with a waiting-side connector assembled to a holder substantially simultaneously while fastening the casing main body with the holder. The method also comprises creating a stress that substantially balances a stress created by connecting the waiting-side connector and the mating connector.

The method may also comprise providing a dummy housing that projects from the casing main body substantially along a connecting direction and providing an opening at a portion of the holder substantially corresponding to the dummy housing. The step of creating the substantially balanced stress may comprise fitting the dummy housing into the opening so that a force for fitting the dummy housing into the opening balances the stress created upon connecting the waiting-side connector and the mating connector.

These and other features of the invention will become more apparent upon reading the following detailed description and accompanying drawings. It should be understood that even though embodiments are described separately, single features thereof may be combined to additional embodiments.

DETAILED DESCRIPTION OF THE PREFERRED EMBODIMENTS

An automotive electrical connection box according to a first embodiment of the invention is identified by the numeral 10 in FIGS. 1 to 4 and has a casing main body 11 with upper and lower surfaces. The automotive electrical connection box 10 has a cover (not shown) and a holder 20 fixed respectively to the upper and lower surfaces of the casing main body 11. The casing main body 11 and the holder 20 are connectable substantially along a connecting direction CD and are fixed by inserting a bolt B substantially along the connecting direction CD through the center of the casing main body 11. The bolt B then is engaged with a nut N embedded in the holder 20.

Figure 2A:
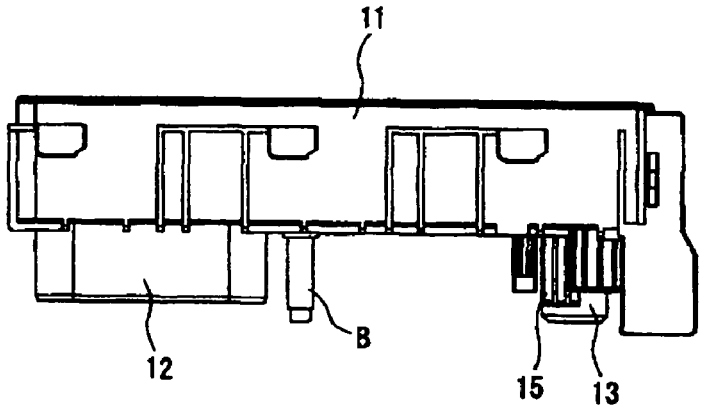
FIGS. 2(A) and (B) are front and bottom views of a casing main body.
Figure 2B:
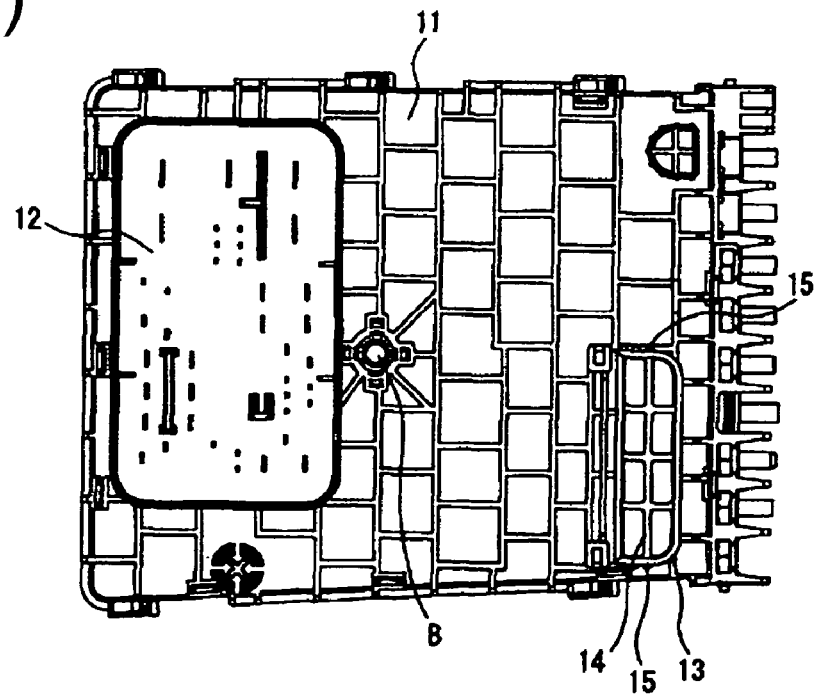

A mating connector 12 is provided on the bottom surface of the casing main body 11 to one side of the bolt B and projects down along the connecting direction CD, as shown in FIG. 2. The mating connector 12 connects with a water-tight waiting-side connector 21 when the bolt B fastens the casing main body 11 and the holder 20, shown in FIG. 3.

A dummy housing 13 is provided on the bottom surface of the casing main body 11 and projects down towards the holder 20 substantially along the connecting direction CD. The dummy housing 13 and the mating connector 12 are disposed symmetrically on opposite sides of the bolt B. The dummy housing 13 has no function with respect to the electrical connection. A substantially lattice-shaped reinforcement 14 is provided inside the dummy housing 13 for strength. Further, three interference ribs 15 project on the outer surface of each of the opposite shorter walls of the dummy housing 13, and the bottom end surfaces of the interference ribs 15 are slanted with respect to the connecting direction CD. The dummy housing 13 projects substantially the same distance from the bottom surface of the casing main body 11 as the mating connector 12.

Figure 3:
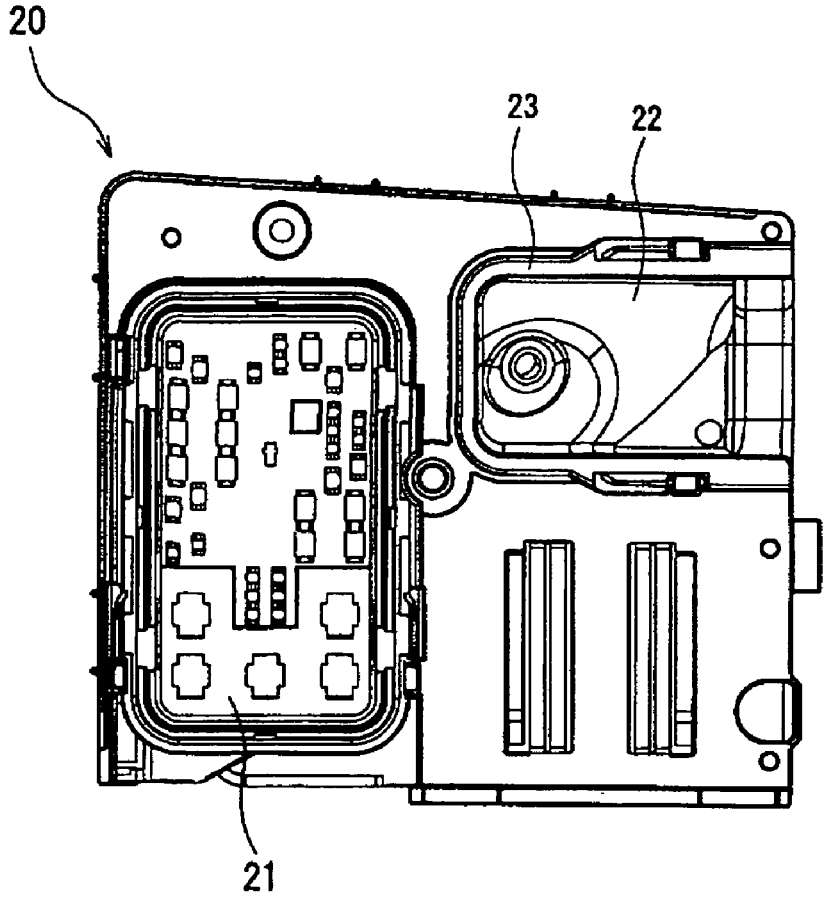
FIG. 3 is a plan view of a lower holder.
Figure 4A:
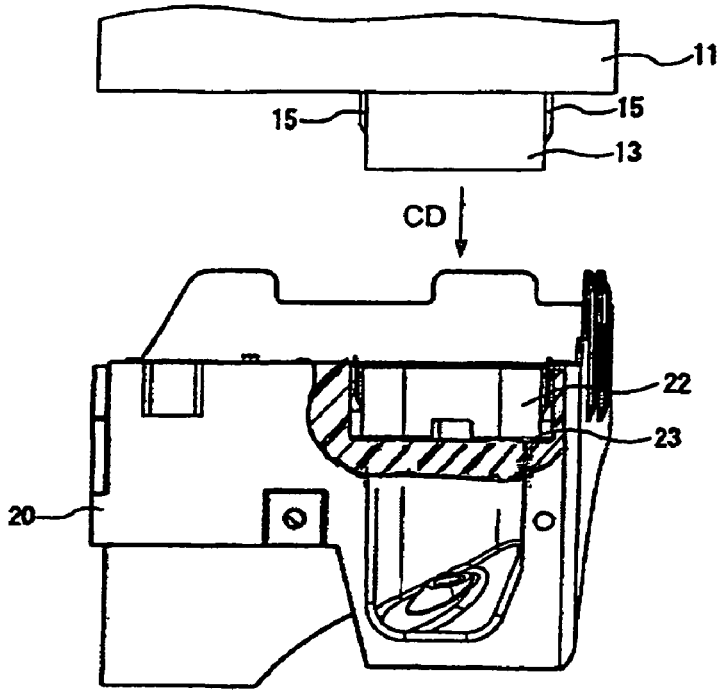
FIGS. 4(A) and 4(B) are diagrams showing states where and after a dummy housing portion is closely fitted into an opening, respectively.
Figure 4B:
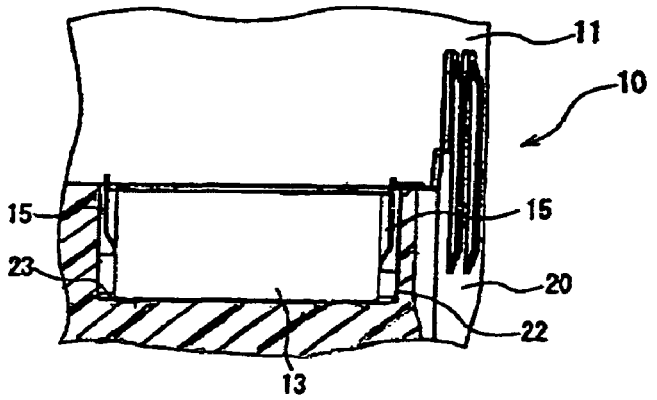

As shown in FIGS. 3 and 4, an opening 22 is provided at a position on the holder 20 substantially corresponding to the dummy housing 13. The opening 22 is dimensioned so that the shorter side walls of the dummy housing 13 fit closely in the opening 22. A step 23 is provided at a middle position of the opening 22 with respect to the connecting direction CD for contacting the bottom end surface of the dummy housing 13. A cross-sectional area of the opening 22 behind the step 23 is smaller than the cross-sectional area of the dummy housing 13. Thus, the step 23 stops the dummy housing 13.

The mating connector 12 in the casing main body 11 connects with the waiting-side connector 21 in the holder 20 when the casing main body 11 and the holder 20 are fastened by the bolt B. Additionally the interference ribs 15 on the outer surfaces of the dummy housing 13 of the casing main body 11 interfere with the inner peripheral surfaces of the opening 22 of the holder 20 to create a stress balanced with the stress created by connecting the connectors 12, 21. The end surface of the dummy housing 13 contacts the step 23 of the opening 22 when the mating connector 12 and the waiting-side connector 21 connect to prevent the bolt B from being tightened further.

Figure 1:
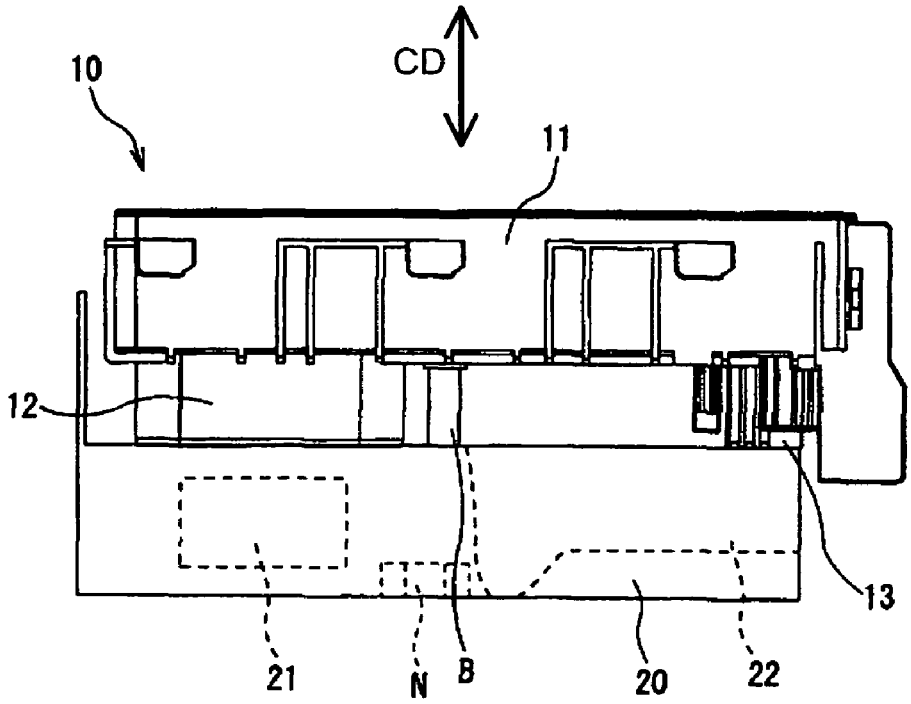
FIG. 1 is a diagram showing an electrical connection box according to a first embodiment of the invention.

The dummy housing 13 projects from the casing main body 11 and fits into the opening 22 in the holder 20. The stress created by fitting the dummy housing 13 into the opening 22 offsets the stress created by connecting the waiting-side connector 21 and the mating connector 12. Thus, stresses are substantially equally and symmetrical over substantially the entire casing main body 11 when the casing main body 11 and the holder 20 are fastened by the bolt B. Accordingly, the casing main body 11 is lowered straight, as shown in FIG. 1 without being held oblique to the holder 20. Therefore, the waiting-side connector 21 can be connected properly with the mating connector 12 to prevent terminals from being damaged.

Stress is created by interference between the interference ribs 15 of the dummy housing 13 of the casing main body 11 and the inner peripheral surfaces of the opening 22 of the holder 20. This stress can be varied by changing the number of interference ribs 15 and adjusting the projecting distance of the interference ribs 15 to balance the stress created by the connection of the connectors. As a result, the dummy housing 13 can be pressed continuously into the opening 22.

The dummy housing does not require the interference ribs if the stress created by connecting the connectors is not large. In this case, the stress created by connecting the connectors can be balanced with a stress created by closely fitting the outer peripheral surfaces of the dummy housing and the inner peripheral surfaces of the opening.

Figure 5:
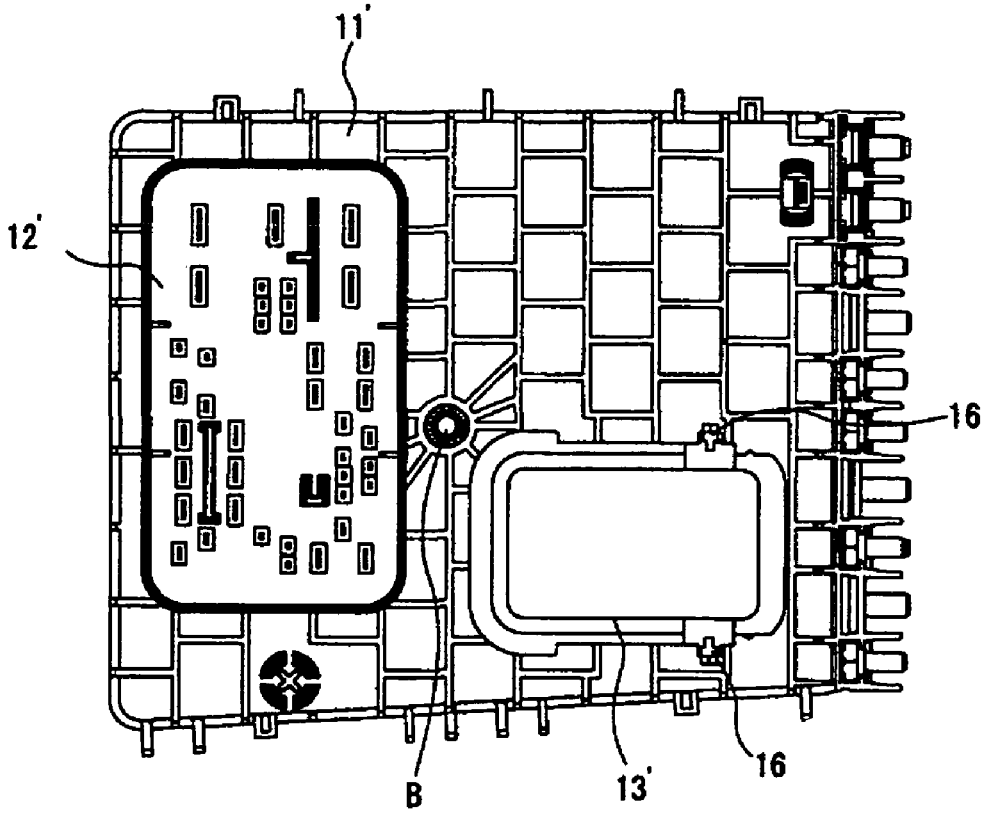
FIG. 5 is a bottom view of a casing main body of an electrical connection box according to a second embodiment.
Figure 6A:
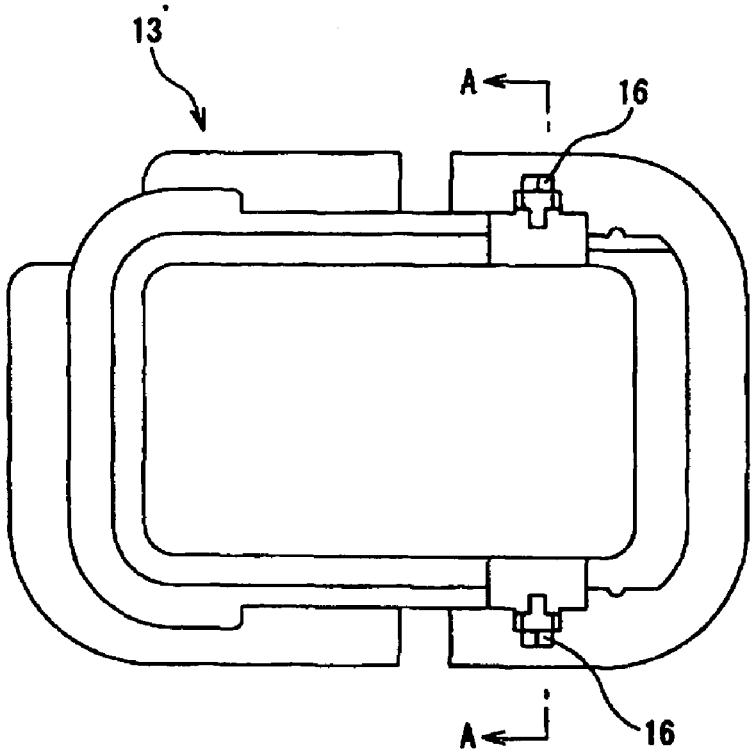
FIG. 6(A) is a bottom view of a dummy housing portion of the second embodiment and FIG. 6(B) is a section along 6(B)—6(B) of FIG. 6(A).
Figure 6B:
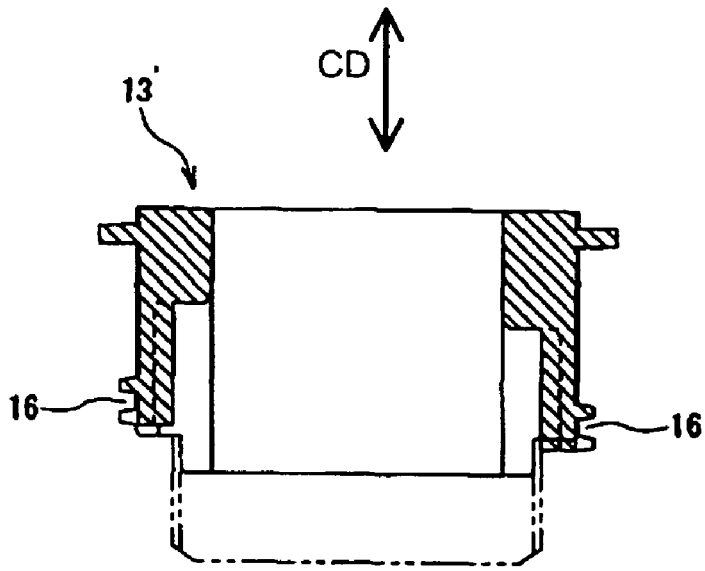

FIGS. 5 to 7 show a second embodiment of the invention. In the second embodiment, a dummy housing 13' of a casing main body 11' and an opening 22' of a holder 20' differ in shape from those of the first embodiment to give a proper sense of an ongoing fitting process while fitting the dummy housing 13' into the opening 22' along the connecting direction CD.

Specifically, locks 16 project to face the outer surfaces of the opposite longer side walls of the dummy housing 13'. The locks 16 have substantially U-shaped cross sections in a direction normal to the connecting direction CD. Locking projections 24 project from the inner peripheral surfaces of the opening 22' of the holder 20' for engaging the locks 16.

Figure 7A:
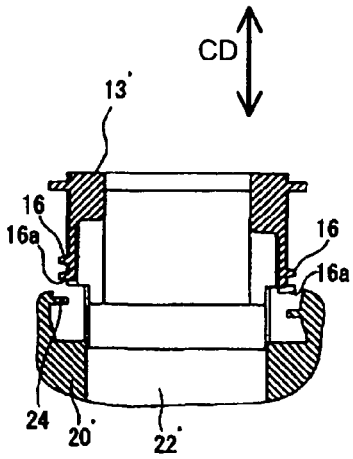
FIGS. 7(A) to 7(D) are diagrams showing a process of engaging the dummy housing portion with the opening in a stepwise manner.
Figure 7B:
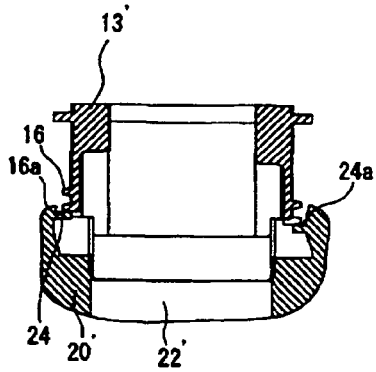
Figure 7C:
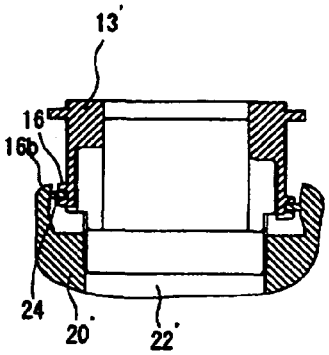
Figure 7D:
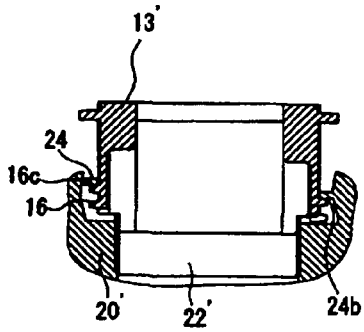

Lower surfaces 16*a* of the locks 16 of the dummy housing 13' contact upper surfaces 24*a* of the locking projections 24 of the opening 22', as shown in FIG. 7(B), as the casing main body 11' and the holder 20' are fastened along the connecting direction CD. This contact creates a stress. Further tightening of the bolt B causes lower projections of the locks 16 to move over the locking projections 24, which then engage recesses 16*b* of the locks 16, as shown in FIG. 7(C). The bolt B is tightened further so that rear projections of the locks 16 move over the locking projections 24. As a result, rear surfaces 16*c* of the locks 16 contact lower surfaces 24*b* of the locking projections 24 as shown in FIG. 7(D). In this way, the locking projections 24 of the holder 20' sequentially engage the front surfaces 16*a*, the recesses 16*b* and the rear surfaces 16*c* of the locks 16. Thus, the dummy housing 13' is pressed into the opening 22' while giving an operator a proper sense of an ongoing fitting process.

Other elements are similar to or the same as those of the first embodiment. Thus, no description is given for the similar structural elements, and they merely are identified by the same reference numerals as in the first embodiment.

Figure 8:
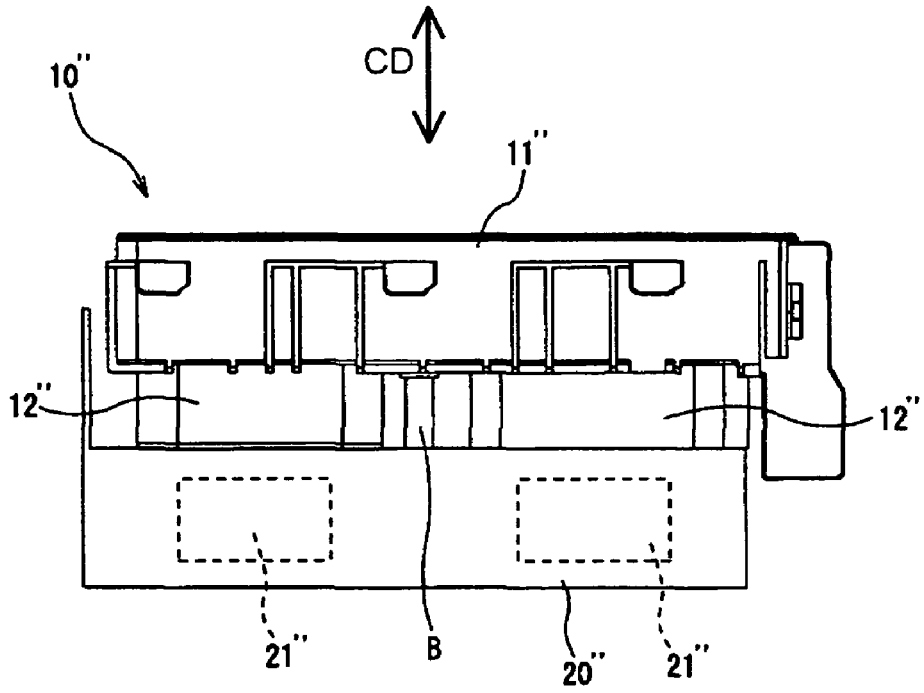
FIG. 8 is a diagram showing an electrical connection box according to a third embodiment.
Figure 9:
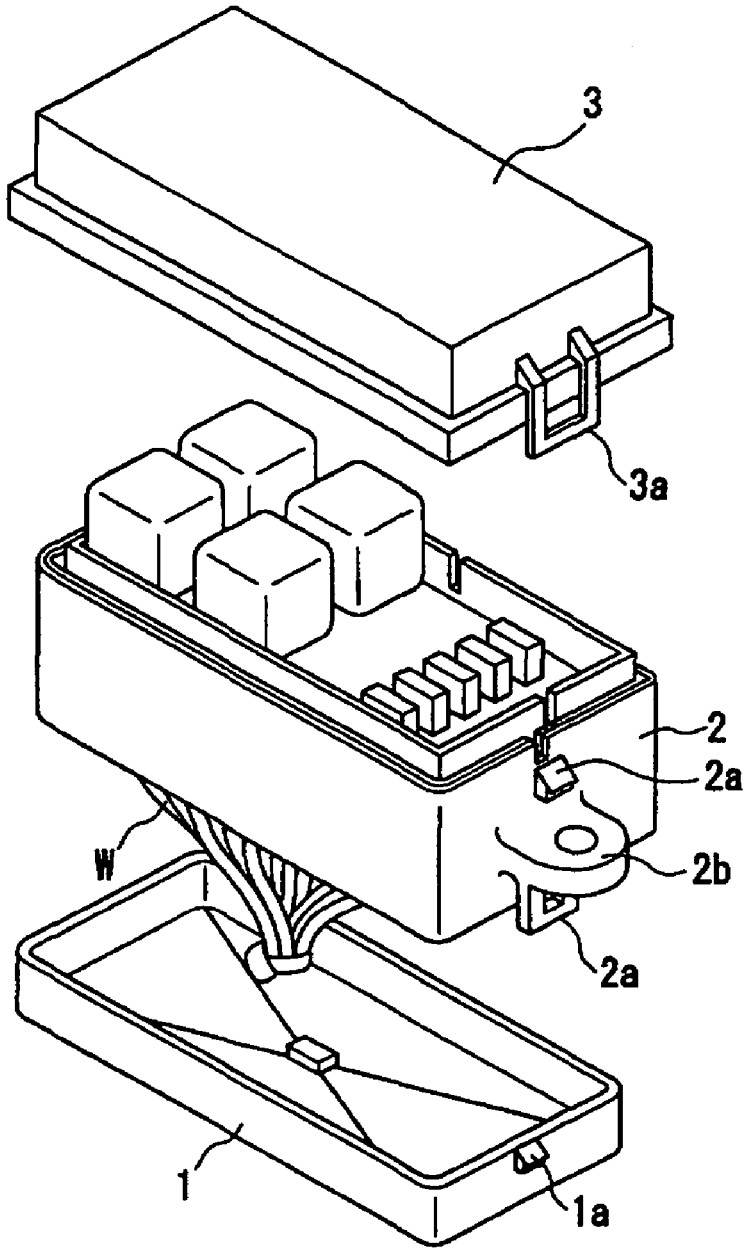
FIG. 9 PRIOR ART
FIG. 9 is a diagram showing a prior art electrical connection box.
Figure 10:
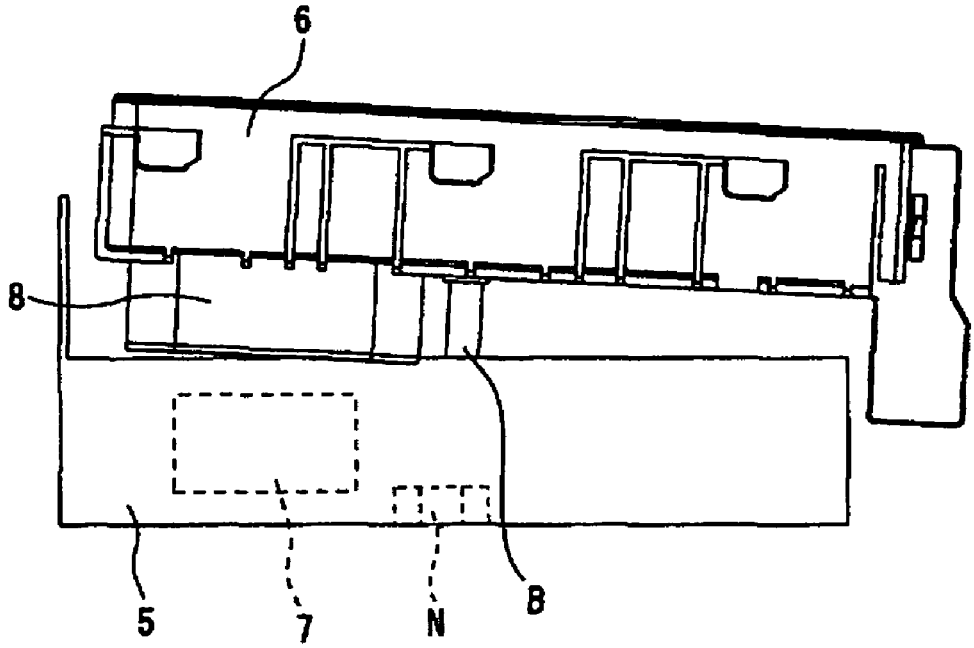
FIG. 10 PRIOR ART
FIG. 10 is a diagram showing a problem of the prior art electrical connection box.

FIG. 8 shows a third embodiment, in which a dummy housing or a mating connector 12" is detachably mountable into the same opening of a casing main body 11", and an opening of a holder 20" is shaped so that a waiting-side connector 21" is detachably mountable therein. Accordingly, in the third embodiment a plurality of connectors 12" can be mounted into the casing main body 11" and are connectable with a corresponding number of waiting-side connectors 21".

Two connectors may be required in an electrical connection box 10". In this case, the waiting-side connectors 21" are mounted into the openings of the holder 20" and the mating connectors 12" are mounted into the openings of the casing main body 11", as shown in FIG. 8.

On the other hand, only one connector may be required in the electrical connection box 10". In this case, the dummy housing is mounted into the opening of the casing main body 11", and nothing is mounted into the opening of the holder 20" similar to the first embodiment.

In this way, the electrical connection box 10" is commonly used for mounting one, two or more connectors.

Other elements are similar to or the same as those of the first embodiment. Thus, no description is given for the similar structural elements, and they merely are identified by the same reference numerals as in the first embodiment.

What is claimed is:

1. An automotive electrical connection box in which a casing main body is fastened to a holder by a fastening means, a mating connector provided in the casing main body is connected with a waiting-side connector assembled to the holder substantially simultaneously with the fastening by the fastening means, wherein a stress creating portion is provided for creating a stress substantially balanced with a stress created upon connecting the waiting-side connector and the mating connector, the stress creating portion comprising a dummy housing projecting substantially along a connecting direction from the casing main body and an opening at a portion of the holder substantially corresponding to the dummy housing and into which the dummy housing is fittable, the dummy housing being substantially rectangular and having two opposed long side walls and two opposed short side walls, interference ribs projecting out from each of the short side walls of the dummy housing, the opening of the holder being substantially rectangular and having two opposed long inner peripheral surfaces and two opposed short inner peripheral surfaces for interfering with the interference ribs on the short walls of the dummy housing so that a force for fitting the dummy housing into the opening is substantially balanced with the stress created upon connecting the waiting-side connector and the mating connector.

2. The automotive electrical connection box of claim 1, wherein the fastening means comprises a bolt.

3. The automotive electrical connection box of claim 1, wherein at least one reinforcing rib is inside of the dummy housing.

4. The automotive electrical connection box of claim 1, wherein the opening is formed with a step for contacting a front end surface of the dummy housing.

5. The automotive electrical connection box of claim 1, wherein at least one lock (16) projects from an outer peripheral surface of the dummy housing (13), at least one locking projection (24) projects from an inner peripheral surface of the opening (22) into which the dummy housing (13) is fittable.

6. The automotive electrical connection box of claim 5, wherein the locking projection (24) is sequentially engageable with a front surface (16*a*), a recess (16*b*) and a rear surface (16*c*) of the lock (16) when the dummy housing (13) is fit into the opening (22).

7. The automotive electrical connection box of claim 1, wherein the dummy housing (13) is mounted detachably to a mounting portion in the casing main body (11), a second mating connector (12) being mountable to the mounting portion in the casing main body (11) upon removing the dummy connector (13), a second waiting-side connector (21) being detachably mountable in the opening of the holder (20) and being connectable with the second mating connector (12) when the second mating connector (21) is mounted in the casing main body (11).

8. An automotive electrical connection box, comprising:

a casing main body;

a holder;

a bolt for urging the casing main body and the holder together;

a casing connector disposed in the casing main body between a first side of the casing main body and the bolt;

a holder connector disposed in the holder between a first side of the holder and the bolt so that the casing connector and the holder connector are connected as the bolt urges the casing main body and the holder together; and stress creating portions on the casing main body and the holder substantially opposite the casing connector and the holder connector with respect to the bolt for creating a stress for at least partly balancing a stress created upon connecting the casing connector and the holder connector the stress creating portion comprises a dummy housing in the casing main body and an opening at a portion of the holder substantially corresponding to the dummy housing and into which the dummy housing is fittable, the dummy housing being substantially rectangular and having opposed long side walls and opposed short side walls, interference ribs being formed on the short side walls, the opening being substantially rectangular and having opposed long inner peripheral surfaces and opposed short inner peripheral surfaces disposed and configured for interfering with the interference ribs and creating a force for substantially balancing the stress created upon connecting the casing connector and the holder connector.

9. The automotive electrical connection box of claim 8, wherein at least one reinforcing rib is inside of the dummy housing.

10. The automotive electrical connection box of claim 9, wherein the opening is formed with a step for contacting a front end surface of the dummy housing.

11. The automotive electrical connection box of claim 8, wherein the dummy housing (13) is mounted detachably to a mounting portion in the casing main body (11), a second casing connector (12) being detachably mountable to the mounting portion in the casing main body (11) upon removing the dummy housing (13), a second holder connector (21) being detachably mountable to the opening (22) in the holder (20) and being connectable with the second casing connector (12) as the bolt (B) urges the casing main body (11) and the holder (20) together.

* * * * *